US005437769A

United States Patent [19]

Bando et al.

[11] Patent Number: 5,437,769

[45] Date of Patent: Aug. 1, 1995

[54] DEWATERING INSTRUMENT FOR A PAPER MACHINE TWIN-WIRE FORMER

[75] Inventors: Takashi Bando; Kazuhide Sakamoto; Hiromu Masuda, all of Mihara; Hiroshi Iwata, Hiroshima, all of Japan

[73] Assignee: Mitsubishi Jukogyo Kabushiki Kaisha, Tokyo, Japan

[21] Appl. No.: 141,934

[22] Filed: Oct. 28, 1993

[30] Foreign Application Priority Data

Oct. 29, 1992 [JP] Japan ..... 4-312672

[51] Int. Cl.[6] ..... D21F 1/54

[52] U.S. Cl. ..... 162/301; 162/352

[58] Field of Search ..... 162/300, 301, 352, 374

[56] References Cited

U.S. PATENT DOCUMENTS

| | | | |
|---|---|---|---|
| 3,017,930 | 1/1962 | Dunlap | 162/352 |
| 3,027,940 | 4/1962 | Dunlap | 162/352 |
| 4,523,978 | 6/1985 | Pullinen | 162/352 |
| 5,061,347 | 10/1991 | Bubik et al. | 162/352 |
| 5,211,814 | 5/1993 | Jaakkola et al. | 162/352 |
| 5,262,010 | 11/1993 | Bubik et al. | 162/352 |

FOREIGN PATENT DOCUMENTS

| | | | |
|---|---|---|---|
| 2012871 | 3/1970 | France | 162/352 |

*Primary Examiner*—Karen M. Hastings
*Attorney, Agent, or Firm*—Wenderoth, Lind & Ponack

[57] ABSTRACT

A dewatering instrument of a twin-wire former allows the angles at which the wires are wrapped around the dewatering blades to be adjusted even during operation so that pulsating pressure applied to the paper stock may be set appropriately according to the prevailing paper making condition. The respective dewatering blades of the dewatering instrument are supported by two support bodies, the first one of which is fixed and pivotably supports the blade, and the second one of which is movable to pivot the blade about the first. For example, the second support body may be a flexible tube which is inflatable and deflatable. When the blade is pivoted, the attitude of the land of the blade is changed so that the wrap angles of the wires with respect to the land of the dewatering blade are adjusted.

9 Claims, 4 Drawing Sheets

DEWATERING INSTRUMENT FOR A PAPER MACHINE TWIN-WIRE FORMER

BACKGROUND OF THE INVENTION

1. Field of the Invention

The present invention relates to dewatering blades in a dewatering instrument applicable to a twin-wire former of a paper making machine.

2. Description of the Prior Art

Generally in a twin-wire former, stock located between the two wires is dewatered during its travel by various dewatering instruments and thereby gradually assumes the form of a fiber mat. Thus, a paper web is formed.

The general structure of a twin-wire former in the prior art is shown in FIG. 6, and details of a representative fixed dewatering instrument employed by such a twin-wire former are shown in FIG. 5. In FIGS. 5 and 6, stock 9 ejected from a headbox 5 is dewatered simultaneously to both the upper and lower sides of the wires, due to a squeezing effect created by the tension of the wires, in a gap 10 just behind a breast roll 3 and a forming roll 4. The stock is also dewatered by a pulsating pressure acting upon the stock in the downstream fixed dewatering equipment 6. Water extracted upward at that time is scraped out by an auto-slice blade 7*a* and is accumulated in an auto-slice 7 to be exhausted.

FIG. 4 shows prior art dewatering blades of a fixed dewatering instrument and a dewatering pressure profile generated in the fixed dewatering instrument. Dewatering blades 6*b* are supported from T-bars 6*c* disposed along a circular arc, having a radius of curvature $R_2'$, on a main body of the dewatering equipment and are extractible in the widthwise direction of the equipment. Accordingly, the top surfaces of the dewatering blades 6*b* lie on a circular arc having an approximate radius of curvature $R_2$. However, because of the fact that the top surface of each dewatering blade 6*b* is planar and spaces are present between the blades, the actual path along which the wire travels has the shape of a sector of a polygon. A pulse-shaped pressure generated in the dewatering blade section is considered to be caused by variations of a moment applied to the stock when the stock between two wires travels beyond the blades. In addition, as wrap angles (inlet side: $\theta_1$, outlet side: $\theta_2$) of the wires at blade end portions, which angles are a predetermined factor in the generation of pressure, become large, the generated pressure also becomes large. The wrap angle is determined by the radius of curvature $R_2$ and a spacing L or L' between the blades, and the smaller the radius of curvature is, and the larger the spacing is, the larger the wrap angle becomes.

In FIG. 4, since the radius of curvature $R_2$ has a predetermined value, as the spacing L becomes larger, the wrap angle also becomes larger. Consequently, a larger pulsating pressure can be obtained. (Solid lines indicate the case where the blades are disposed only on every other T-bar, and solid lines and dashed lines jointly depict the case where a full number of blades are used.)

The auto-slide blade 7*a* is normally set at such a location that it will contact a second wire 2 under the condition where stock is not present. However, during operation, because of the thickness of the stock, the wire has wrap angles at the rear end of the final dewatering blade and at the front end of the auto-slice blade 7*a*. Therefore, pressure similar to that in the fixed dewatering equipment will be generated between these blades.

While it has been generally known that a shearing force acts on the stock due to the pressure pulses generated in the fixed dewatering instrument, whereby a dispersion of fibers is promoted, if a large pressure is applied to the stock from the time of initial mat formation when the fibers are more free to move, then a well-formed mat is produced. On the other hand, fibers in a middle portion of the mat become oriented to a high degree. In addition, since the dewatering blades form the outer layers of the mat adjacent the first wire and the second wire differently, if a strong squeezing action is applied to the stock at the time of initial mat formation (i.e. if a large inlet side wrap angle is used), then the porosity of the paper layer adjacent the first wire becomes high, a yield of micro-fine fibers and an ash component become poor, and the difference in characteristics between the respective outer layers, namely the sides of the paper (micro-fine fiber distribution, ash component distribution, ink-absorbing property, etc.) becomes great. In other words, it becomes difficult to obtain a uniform mat (see Japanese Pat. Appln. No. 2-199230 (1990) [Laid-Open Japanese Patent Specification No. 4-91287 (1992)]).

Accordingly, the pulsating pressure applied to the stock should be controlled depending upon the degree of formation of the mat. However, in the prior art, such a control must be effected by changing the blades because the radius of curvature $R_2$ is fixed. However, the changing of the blades requires stopping the paper making machine and hence is inefficient and is not practiced very much in the prior art.

Moreover, if the thickness of stock passing through the auto-slice blade section is too thick, the wire wrap angle becomes excessive and, if a gap is provided between the blade 7*a* and the second wire 2 in order to avoid this, then the upwardly extracted water easily passes through the gap between the blade 7*a* and the second wire. In either case, there is a possibility of destroying the formed mat. As described above, the positioning of the auto-slice 7 is a delicate operation. Therefore, changing the position of the auto-slice 7 according to the prevailing paper making conditions has not been practiced.

SUMMARY OF THE INVENTION

It is therefore one object of the present invention to provide a dewatering instrument for a twin-wire former of a paper making machine, wherein a wrap angle of wires, which angle is a predominant factor in establishing the profile of the pulsating pressure applied to the stock, can be changed even during operation so that pulsating pressure, appropriate for the prevailing paper making condition, is generated.

To achieve this object of the present invention, there is provided in a twin-wire former having to wire loops, a dewatering instrument including dewatering blades each supported by two support bodies, among which the first support body is fixed but pivotably supports the blade, while the second support body is movable to pivot the blade about the first.

The second support body may comprise a flexible tube.

On the other hand, the first support body may comprise a T-bar or a circular rod.

The pulsating pressure generated in the blade section of a twin-wire former is considered to be caused by variations in the moment applied to the stock when the stock interposed between the two wires travels past the blades. As the wrap angles (inlet side: $\theta_1$, outlet side: $\theta_2$) of the wires at the blade ends become large, the generated pressure also becomes large. By employing blades having lands whose attitude may be adjusted according to the present invention, it becomes possible to vary the pressure without changing the number of blades, the pitch at which the blades are mounted to the main body, and the radius of curvature of the mounting surface of the main body.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENTS

Figure 1A:
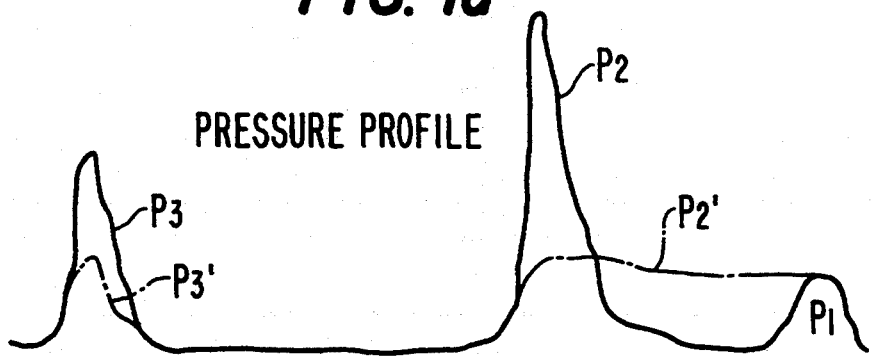
FIG. 1 is a schematic view of a dewatering blade of a first preferred embodiment of a dewatering instrument according to the present invention.
Figure 1B:
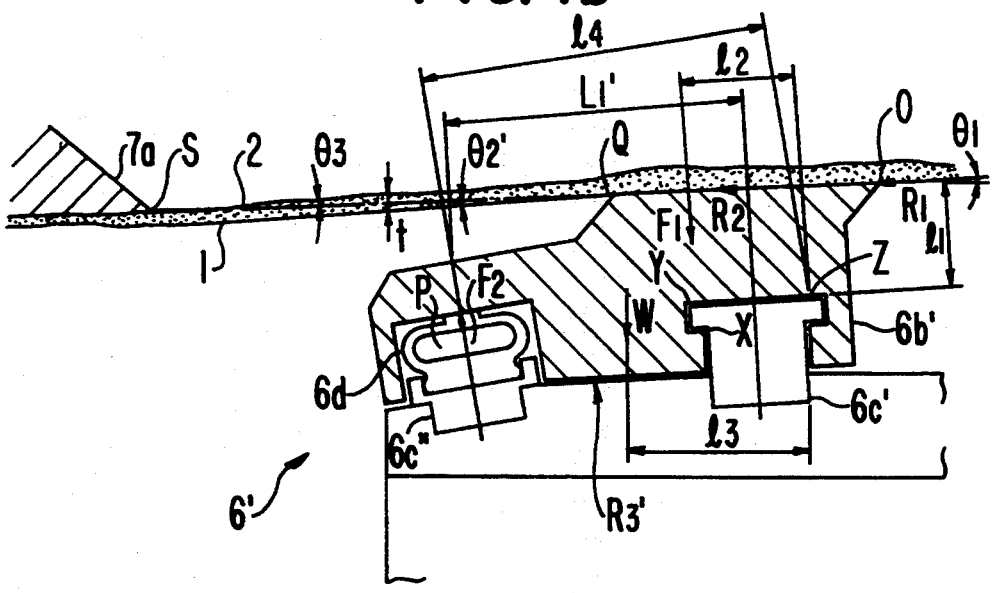
Figure 3A:
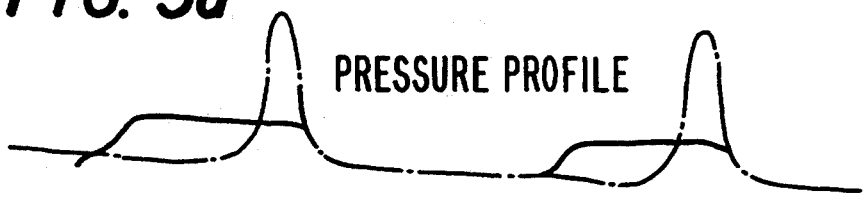
FIG. 3 is a schematic view of dewatering blades of a dewatering instrument according to the present invention.
Figure 3B:
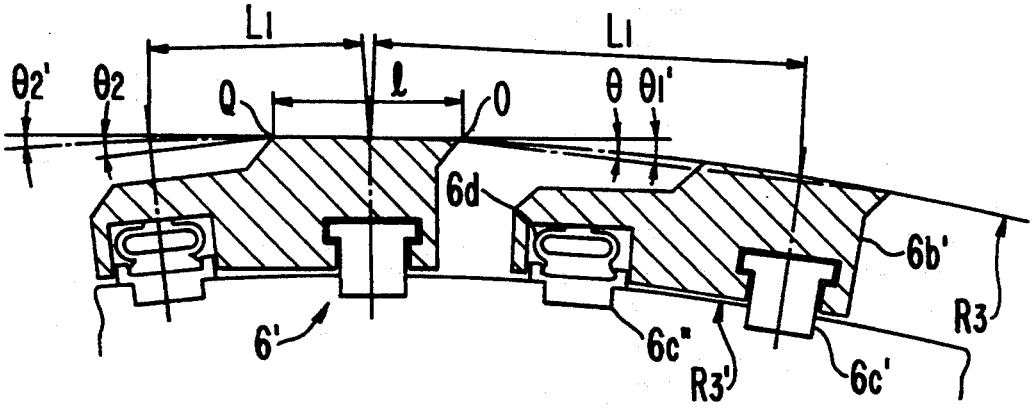
Figure 4A:
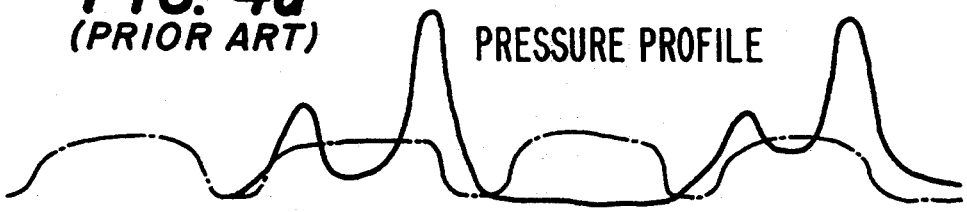
FIG. 4a (PRIOR ART)
FIG. 4 is a schematic view of dewatering blades of a dewatering instrument of the prior art.
Figure 4B:
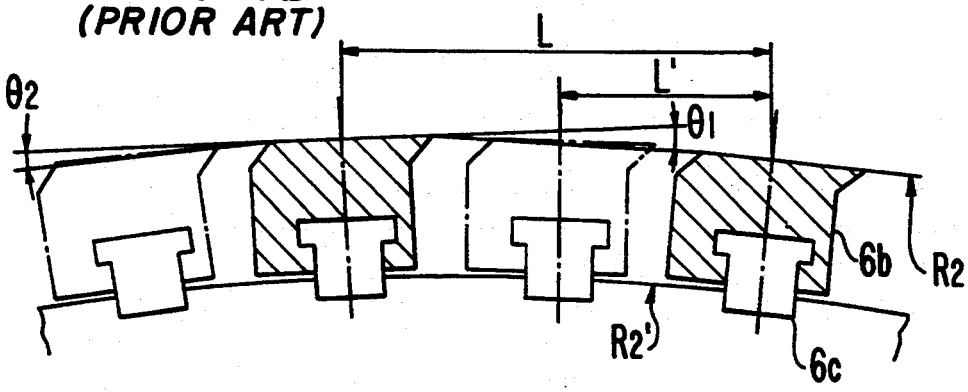
FIG. 4b (PRIOR ART)

In the following, the present invention will be described in connection with the preferred embodiments illustrated in the accompanying drawings. A first preferred embodiment of the present invention is shown in FIGS. 1 and 3. These figures show the dewatering blades of the dewatering instrument 6 of the present invention as well as a pressure profile generated in relation to the blades.

A main body of a dewatering instrument 6' has a similar structure to the main body of the dewatering instrument 6 in the prior art, and its upper surface is a curved surface having a radius of curvature $R_3$. And, T-bars 6c' similar to those in the prior art and T-bars 6c'' having a dovetail groove in their upper surface are alternately mounted on the main body at a pitch $L_1'$. Furthermore, a tube 6d expansible by hydraulic pressure is disposed in the dovetail groove of the T-bar 6c''.

Figure 2:
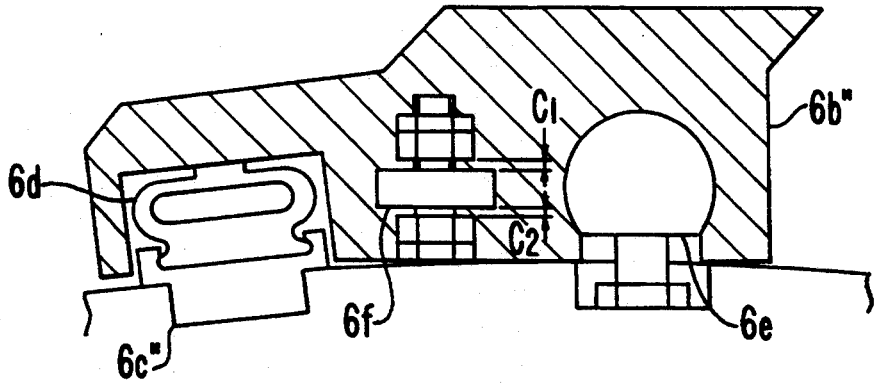
FIG. 2 is a cross-sectional view of a dewatering blade of a second preferred embodiment of the present invention.

The dewatering blade 6b' defines a T-shaped groove similar to that of the heretofore known blade to accommodate T-bar 6c' and a box-shaped groove to accommodate the expansible tube 6d. Each blade 6b' is extractible in the widthwise direction of the main body similarly to the blades in the prior art. At the time of operation, the dewatering blade 6b' is supported at two locations, namely on the upper surface of the T-bar 6c' and on the upper surface of the expansible tube 6d. The t-bar 6c' is located directly beneath the land of the dewatering blade 6b' and the expansible tube 6d is spaced from the land of the blade. As can be seen in FIGS. 1–3, each dewatering blade has a surface intersecting the land at an upstream terminal edge thereof at an acute angle so as to form a rake contacting the wire 1.

In FIG. 1, when a center line of a land of the blade 6b' coincides with a center line of the T-bar 6c', wrap angles $\theta_1$ and $\theta_2$ at the front end O and at the rear end Q of the land become equal to each other, and are represented by the following equation:

$$\theta_1=\theta_2=L_1/2R_3 \text{ (rad)} \quad (1)$$

On the other hand, it is possible to adjust the wrap angle of the wires in a manner to be described later by adjusting the expansible tube 6d, and it is possible both to generate a small pressure over the entire land of the blade (the solid lines representing the case of $\theta_1 \approx \theta_2$) and to generate a large pressure at the front end portion of the blade (the dashed lines representing the case of $\theta_1 >> \theta_2$) as shown in FIG. 3. In addition, if necessary, it is also possible to weaken the degree to which the stock is squeezed by making the wrap angle of the wires at the front ends of the blades small. FIG. 1 shows a pressure profile generated in the case where the blades according to the present invention were employed as final blades in the dewatering equipment 6' just upstream of an auto-slice blade 7a.

As described above, the auto-slice blade 7a is preset in such manner that under the condition where stock is not present the wires will not bend at the rear end Q of the final blade and at the front end S of the auto-slice blade (shown by the dashed lines). However, under a practical operation condition, the wires 1 and 2 are forcibly separated due to a thickness t of the stock between the wires, and consequently the wires tend to bend at the rear end Q of the dewatering blade 6b' and at the front end S of the auto-slice blade. Accordingly, as shown by the pressure profile in FIG. 1, pressures $P_2$ and $P_3$ larger than a normally generated pressure would act at the respective locations. In order to avoid the generation of such excessively large pressures, the tube pressure P is preset so that an appropriate dewatering pressure $P_2'$ may be realized. Specifically, as will be seen from the following equation of equilibrium of moment derived from equations (3) and (4) which will be described later, the position of the dewatering blade is automatically maintained at a proper position regardless of a thickness of incoming stock:

$$l_1\times(R_1+R_2)+l_2\times F_1+l_3\times W=l_4\times F_2 \quad (2)$$

$F_1=f_1(P_2)$: a function of a pressure $P_2$ $F_2=f_2(P)$ : a function of an inner pressure P of the tube.

Next, the operation of the dewatering instrument will be described on the basis of the first preferred embodiment shown in FIG. 1. A blade 6b' has a land held in contact with the wire 1, and it is supported by a T-bar 6c' so as to be extractible in the widthwise direction of the dewatering instrument via a T-shaped groove formed in the lower portion of the blade similarly to the blade 6b in the prior art. However, the gap reserved between the T-shaped groove and the T-bar is somewhat broader than that in the blade of the prior art. In addition, the expansible tube 6d is mounted to a T-bar 6c'' downstream of the T-bar 6c' so that the dewatering blade 6b' is rotatable about a point Z at an upstream end of the top edge of T-bar 6c'. Therefore, it is possible to change an attitude of the blade almost without changing the position of the front (upstream) edge o of the blade.

Now, the position of the blade is determined by the following equations of equilibrium of moment:

$$Mcc = l_1 \times (R_1 + R_2) + l_2 \times F_1 + l_3 \times W \quad (3)$$

$$Mc = l_4 \times F_2 \quad (4)$$

wherein:

Mcc: Moment in the counterclockwise direction about the point Z,

Mc: Moment in the clockwise direction about the point Z, $R_1$: Collisional force of extracted water and wires, $R_2$: Frictional force acting upon wires and the blade land, $F_1$: Force due to dewatering pressure $P_2$ acting upon the blade proximate the rear (downstream) edge thereof, $F_2$: Force due to hydraulic pressure P within the expansible tube, W: Weight of the blade.

If the force $F_2$ is changed by means of the expansible tube 6d to upset the above-described equilibrium:

In the case of Mc>Mcc:

The blade rotates in the clockwise direction, $\theta_1$ becomes small, and the generated pressure $P_1$ also becomes small. A portion X of the blade will strike the T-bar 6c' to restrict the movement of the blade so that a gap will not be formed between the front end of the blade and the wire.

In the case of Mc<Mcc:

The blade rotates in the counterclockwise direction, $\theta_1$ becomes large, and generated pressure $P_1$ also becomes large. The maximum value of $\theta_1$ is determined by a radius of curvature $R_3$ and a spacing L, and is represented by the following equation:

$$\theta_1 \max = L/R_3 \text{ (rad)} \quad (5)$$

FIG. 2 shows a second preferred embodiment of the present invention, in which a circular rod 6e is used instead of the T-bar 6c'. In this embodiment, the blade can be swung about a center axis of the circular rod 6e to adjust the attitude of the blade. In addition, a stopper 6f is provided in the middle portion of the blade between the circular rod 6e and the flexible tube 6d. A wire wrap angle is adjustable over a wide range by appropriately setting clearances $C_1$ and $C_2$ of the stopper 6f shown in FIG. 2.

Figure 5:
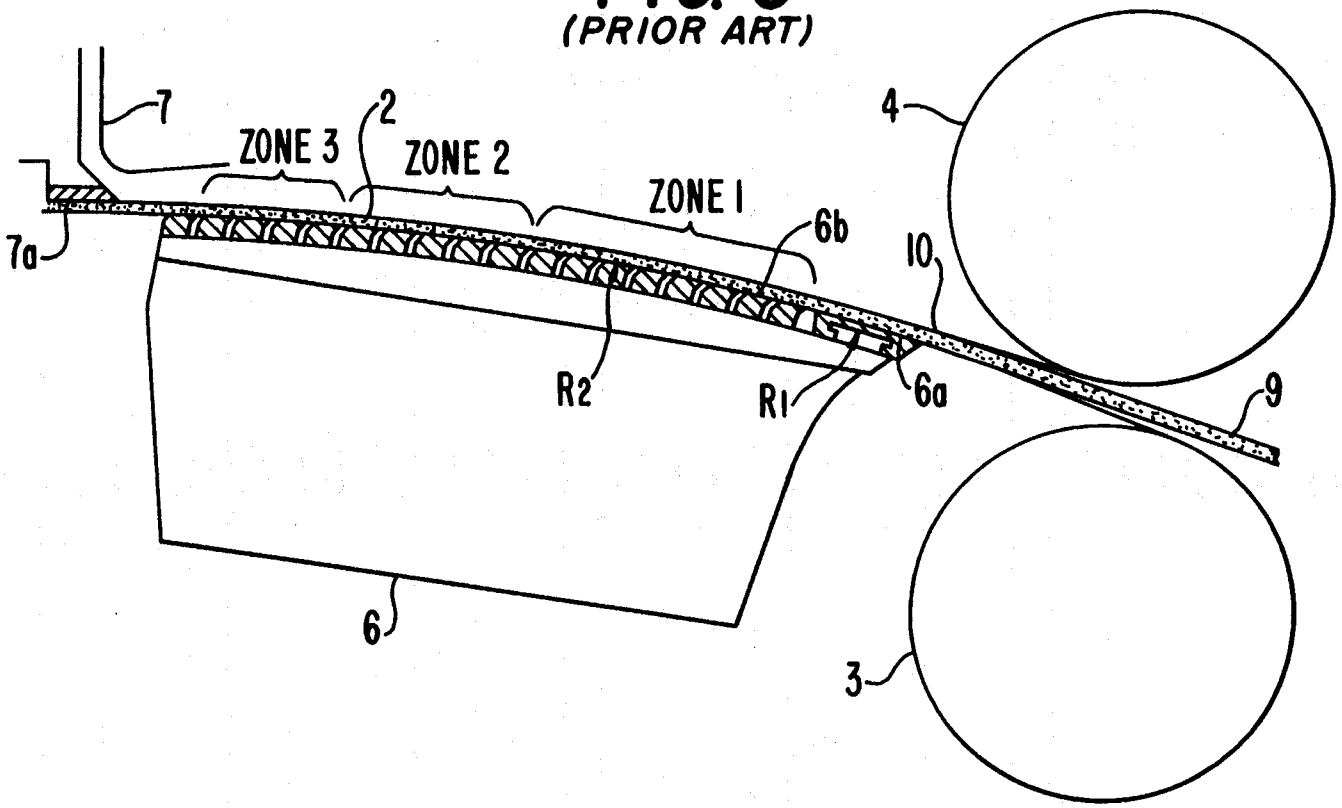
FIG. 5 (PRIOR ART)
FIG. 5 is a cross-sectional view of a fixed dewatering instrument zone in a twin-wire former.
Figure 6:
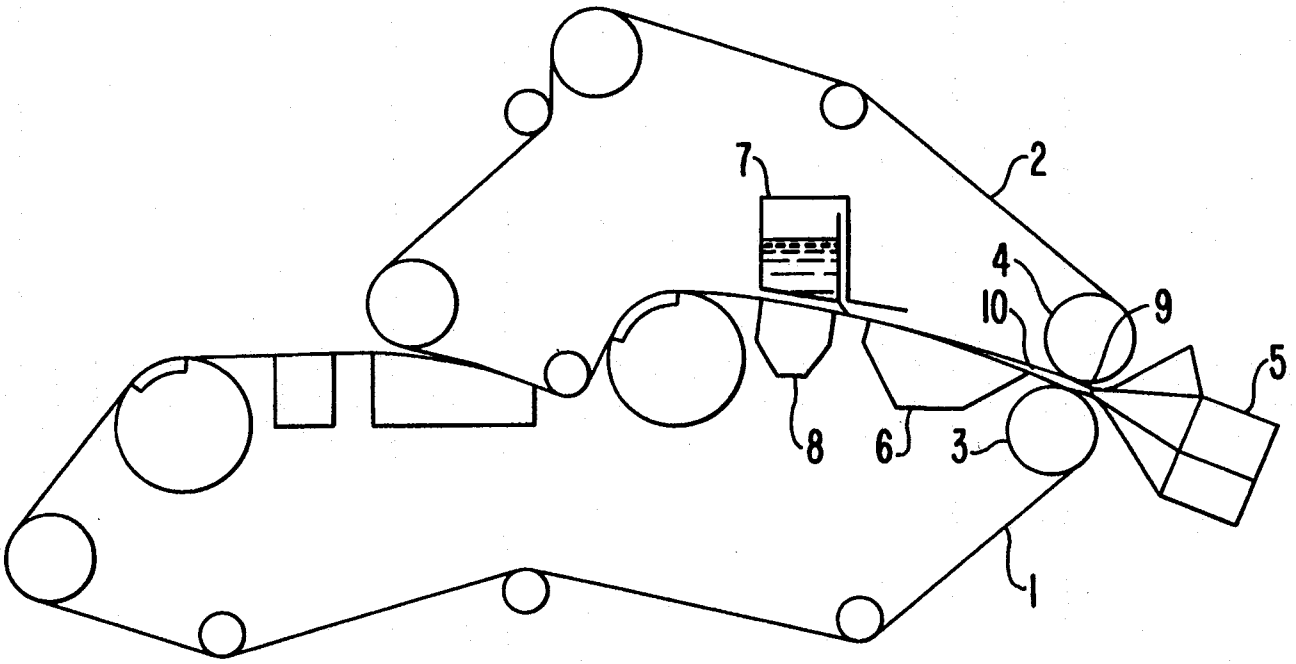
FIG. 6 (PRIOR ART)
FIG. 6 is a side view of the twin-wire former of the prior art.

As described in detail above, according to the present invention, a control of pressure pulses aimed at realizing optimum paper quality becomes possible by supporting the dewatering blades of a dewatering instrument of a wire former of paper making machinery in such a manner that the attitudes of the blades can be externally controlled. This control of pressure pulses can be effected by adjusting the attitudes of the dewatering blades in the respective dewatering zones shown in FIG. 5. More particularly, in the initial paper making step carried out in zone 1, the degree to which the stock is squeezed by the front edges of the blades is made minimum by presetting the attitudes so as to fulfill $\theta_1 << \theta_2$, thereby enhancing retention. In zone 2, the attitudes of the blades are preset so as to establish intermediate wrap angle values $\theta_1 \approx \theta_2$. In zone 3 the attitudes of the blades are preset so as to fulfill $\theta_1 >> \theta_2$. Accordingly, a large pulse-shaped pressure can be exerted on the stock, and even in the case where mat concentration has become high, fiber dispersion can be promoted. In addition, an excessively large pressure generated at a location where the curvature of the dewatering instrument is inflected can be suppressed, and a flexible operation has become possible. In this way, pulse-shaped pressure can be finely controlled in dependence on the particular paper making process. Therefore, fine paper can be produced.

While a principle of the present invention has been described above in connection with preferred embodiments of the invention, it is intended that all matter contained in the description and illustrated in the accompanying drawings be interpreted as illustrative of and not as a limitation to the scope of the present invention.

We claim:

1. In a twin-wire former of a paper making machine having two coacting wire loops, a dewatering instrument comprising: a main body; a plurality of rigid dewatering blades having respective lands constituting upper surfaces of the blades, said blades being supported by said main body adjacent one of the wire loops, said lands of said blades contacting said one of the wire loops at the inside of said one of the wire loops, and said lands lying in and being spaced from one another along an arcuate path as viewed in the traveling direction in which stock travels through the twin-wire former to thereby establish angles at which said one of the wires wraps around the lands such that the blades impart a pulsating pressure to stock traveling past the dewatering instrument in the twin-wire former; the twin-wire former defining an open space adjacent the inside of the other of said wire loops at locations directly opposite locations where said lands contact said one of said wire loops; a respective set of first and second support members mounted to said main body and supporting each of said blades, the first and second support members of each said set being spaced from one another in said traveling direction, each said first support member being fixed and pivotably supporting the respective dewatering blade, each said first support member being disposed directly beneath the land of the respective dewatering blade, and each said second support member being movable relative to said main body so as to pivot the respective dewatering blade supported thereby and the land of the blade contacting said one of the wires about the first support member pivotably supporting the respective blade, whereby angles at which said one of the wires are wrapped about the lands of the dewatering blades are adjustable, respectively, to vary the pulsating pressure imparted to stock traveling past the dewatering instrument in the twin-wire former.

2. A dewatering instrument in a twin-wire former as claimed in claim 1, wherein said second support member comprises an inflatable and deflatable flexible tube.

3. A dewatering instrument in a twin-wire former as claimed in claim 1, wherein said blades each define a T-shaped groove, and said first support member comprises a bar having a T-shaped cross section received in said T-shaped groove.

4. A dewatering instrument in a twin-wire former as claimed in claim 2, wherein said blades each define a T-shaped groove, and said first support member comprises a bar having a T-shaped cross section received in said T-shaped groove.

5. A dewatering instrument in a twin-wire former as claimed in claim 1, wherein said blades each define a groove having a circular sectional shape, and said first support member comprises a rod having a circular sectional shape received in the groove having a circular sectional shape.

6. A dewatering instrument in a twin-wire former as claimed in claim 2, wherein said blades each define a groove having a circular sectional shape, and said first support member comprises a rod having a circular sectional shape received in the groove having a circular sectional shape.

7. A dewatering instrument in a twin-wire former as claimed in claim 1, wherein said main body has a curved upper surface as viewed in said traveling direction, and the first and second support members of each said respective set are mounted to said curved upper surface.

8. A dewatering instrument in a twin-wire former as claimed in claim 1, wherein said second support member is spaced with respect to said traveling direction from said land of the blade supported thereby.

9. A dewatering instrument in a twin-wire former as claimed in claim 8, wherein each of said blades has a surface intersecting the land at an upstream terminal edge thereof at an acute angle so as to form a rake contacting said one of the wires at the upstream end of the blade.

* * * * *